US008600547B2

(12) United States Patent
Petersen et al.

(10) Patent No.: US 8,600,547 B2
(45) **Date of Patent: *Dec. 3, 2013**

(54) SHEET PRODUCT DISPENSER AND METHOD OF OPERATION

(75) Inventors: Gary N. Petersen, Neenah, WI (US); Craig D. Yardley, Roswell, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 175 days.

This patent is subject to a terminal disclaimer.

(21) Appl. No.: 13/186,040

(22) Filed: Jul. 19, 2011

(65) Prior Publication Data

US 2011/0276178 A1 Nov. 10, 2011

Related U.S. Application Data

(63) Continuation-in-part of application No. 12/196,753, filed on Aug. 22, 2008, now Pat. No. 7,996,108.

(51) Int. Cl.
*G06F 17/00* (2006.01)

(52) U.S. Cl.
USPC ..... 700/236; 700/244; 221/7

(58) Field of Classification Search
USPC ..... 221/7; 700/236, 241, 244
See application file for complete search history.

(56) References Cited

U.S. PATENT DOCUMENTS

| | | | | |
|---|---|---|---|---|
| 5,280,274 | A | 1/1994 | Uemura et al. | |
| 5,537,313 | A * | 7/1996 | Pirelli | 705/28 |
| 5,604,992 | A | 2/1997 | Robinson | |
| 5,608,643 | A * | 3/1997 | Wichter et al. | 700/244 |
| 5,878,381 | A | 3/1999 | Gemmell et al. | |
| 6,411,920 | B1 | 6/2002 | McConnell et al. | |
| 6,769,580 | B2 | 8/2004 | Muderlak et al. | |
| 7,213,782 | B2 | 5/2007 | Osborne et al. | |
| 7,242,307 | B1 | 7/2007 | LeBlond et al. | |
| 7,304,569 | B2 | 12/2007 | Marcichow | |
| 7,370,824 | B1 | 5/2008 | Osborne | |
| 7,978,564 | B2 * | 7/2011 | De La Huerga | 368/10 |
| 7,996,108 | B2 * | 8/2011 | Yardley | 700/241 |
| 8,112,175 | B2 * | 2/2012 | Handfield et al. | 700/244 |
| 8,239,062 | B2 * | 8/2012 | Vahlberg et al. | 700/236 |

(Continued)

FOREIGN PATENT DOCUMENTS

| | | | |
|---|---|---|---|
| KR | 100801577 | B1 | 2/2008 |
| WO | 2005065509 | A1 | 7/2005 |
| WO | 2007067106 | A1 | 6/2007 |

OTHER PUBLICATIONS

PCT International Search Report and Written Opinion for International Application No. PCT/US2009/054270; International Filing Date: Aug. 19, 2009; 6 pgs.

*Primary Examiner* — Timothy Waggoner
(74) *Attorney, Agent, or Firm* — Sutherland Asbill & Brennan LLP

(57) ABSTRACT

A product dispenser includes a housing configured to receive a supply of product, a dispensing mechanism disposed and configured to dispense the product, and a controller operably coupled to the dispensing mechanism. The controller includes a processer responsive to executable instructions which when executed by the processor facilitates: recording of usage data associated with the product; calculation of a usage rate of the product; and, prediction of at least one of a depletion date of the product, a time to depletion of the product, a time to near-depletion of the product, and a near-depletion date of the product.

19 Claims, 9 Drawing Sheets

(56) References Cited

U.S. PATENT DOCUMENTS

| | | | | |
|---|---|---|---|---|
| 2002/0007510 | A1 | 1/2002 | Mann | |
| 2005/0171634 | A1 | 8/2005 | York et al. | |
| 2006/0173576 | A1 | 8/2006 | Goerg et al. | |
| 2008/0100185 | A1 | 5/2008 | Lewis | |
| 2009/0204256 | A1 | 8/2009 | Wegelin | |
| 2010/0082458 | A1 * | 4/2010 | Godlewski | 705/28 |

* cited by examiner

SHEET PRODUCT DISPENSER AND METHOD OF OPERATION

CROSS REFERENCE TO RELATED APPLICATIONS

This application is a continuation-in-part application of U.S. application Ser. No. 12/196,753, filed Aug. 22, 2008, which is hereby incorporated by reference in its entirety.

BACKGROUND OF THE INVENTION

The present invention relates generally to a sheet product dispenser, and in particular to a sheet product dispenser that provides feedback to an operator as to when a supply of sheet product will be depleted.

Sheet product dispensers typically include a supply of sheet product, such as in a roll form. The sheet product is dispensed from the roll by passing one end of the sheet product through a pair of rollers. One of the rollers is coupled to an electric motor that is selectively energized by a controller. Friction between the rollers and the sheet product pulls the sheet product from the sheet product roll when the motor is operated. Some type of separation arrangement is also provided for allowing a portion of the sheet product roll to be removed from the dispenser by a user.

The separation arrangement may be provided in several ways. The sheet product may include perforations for example. When sheet product with perforations is used, the dispenser includes a means for positioning the perforations adjacent to the opening where the sheet product is dispensed. The perforations allow the sheet product dispensed to the user to separate when the user pulls on the sheet product.

Alternatively, or in conjunction with the perforations, the dispenser may also have a cutting arrangement. In this arrangement, a cutting device, commonly referred to as a tear bar, is positioned adjacent the opening where the sheet product is dispensed. The tear bar may be a sharp blade, or a serrated blade. The tear bar is positioned such that when the user pulls on the dispensed sheet product, the sheet product engages the tear bar. This action results in the sheet product being cut or torn allowing the user to remove the dispensed portion.

Generally, the sheet product dispenser will also include a controller for performing and controlling the functional operations of the dispenser. The dispenser may control the amount of sheet product dispensed in several ways. One means of controlling the amount of dispensed sheet product is by timing the operation of the motor coupled to the rollers. From the operation of the motor, or by physically detecting the level of a sheet product, the controller may switch to a new sheet product supply, or alternatively activate an "empty" indicator on the housing of the sheet product dispenser. However, this monitoring of the supply of sheet product indicates only the level, or lack thereof, of the sheet product supply and requires that the operator manually check the dispenser on a periodic basis to determine if sheet product is still available to avoid having an interruption in the operation of the dispenser.

While existing sheet product dispensers are suitable for their intended purposes, there still remains a need for improvements, particularly regarding the monitoring of sheet product usage and providing feedback to the operator of when the sheet product supply will be depleted. Further, there is also a need for improvements in communicating the predicted depletion point to an operator.

SUMMARY OF THE INVENTION

A method of operating a sheet product dispenser is provided. The method includes the step of dispensing a sheet product to a user by way of a mechanically or electrically operable sheet product dispenser. Data is recorded in machine-readable format regarding the dispensing of the sheet product. A database is created in machine-readable format of the recorded data. A processor-based controller predicts a date when the sheet product supply will be depleted. The date is displayed on a display panel at the sheet product dispenser.

A sheet product dispenser for dispensing a sheet product disposed therein is also provided. The dispenser includes a dispenser mechanism operably coupled to dispense a predetermined amount of the sheet product. A controller is operably coupled to activate the dispenser mechanism, the controller includes a processor responsive to executable computer instructions when executed on the processor for calculating a predicted depletion date of the sheet product in response to the dispenser system being activated. A display is electrically coupled to the controller.

A sheet product dispenser is also provided having a sensor. A housing is configured to receive a supply of sheet product. A dispensing mechanism is operably coupled to the supply of sheet product and the sensor, wherein the dispensing mechanism dispenses a predetermined amount of sheet product in response to activation of the sensor. A controller is electrically coupled to the sensor and the dispensing mechanism. A data storage device is electrically coupled to the controller. Wherein the controller includes a processor responsive to executable computer instructions when executed on the processor for determining a predicted depletion date of the supply of sheet product in response to the sensor being activated.

A product dispenser is provided having a housing configured to receive a supply of product, a dispensing mechanism disposed and configured to dispense the product, and a controller operably coupled to the dispensing mechanism. The controller includes a processer responsive to executable instructions which when executed by the processor facilitates: recording of usage data associated with the product; calculation of a usage rate of the product; and, prediction of at least one of a depletion date of the product, a time to depletion of the product, a time to near-depletion of the product, and a near-depletion date of the product.

A product dispenser system is provided that includes a product dispenser and a remote facility management system. The product dispenser includes a housing configured to receive a supply of product, a dispensing mechanism disposed and configured to dispense the product, and a controller operably coupled to the dispenser mechanism. The controller includes a processer responsive to executable instructions which when executed by the processor facilitates: recording of usage data associated with usage of the product; calculation of a usage rate of the product; and, prediction of at least one of a depletion date of the product, a time to depletion of the product, a time to near-depletion of the product, and a near-depletion date of the product. A transmitter module is operably coupled to the controller and is configured to transmit data to the remote facility management system, the data relating to at least one of the depletion date of the product, the time to depletion of the product, the time to near-depletion of the product, and the near-depletion date of the product. The remote facility management system includes a receiver module, a data storage module, a data processing module, and a data display module. The receiver module is configured to receive a transmission from the transmitter module. The data storage module, the data processing module, and the data display module, are configured to store, process and display, respectively, the data relating to at least one of the depletion date of the product, the time to depletion of the product, the time to near-depletion of the product, and the near-depletion date of the product.

BRIEF DESCRIPTION OF THE DRAWINGS

Referring now to the drawings, which are meant to be exemplary and not limiting, and wherein like elements are numbered alike.

DETAILED DESCRIPTION

Figure 1:
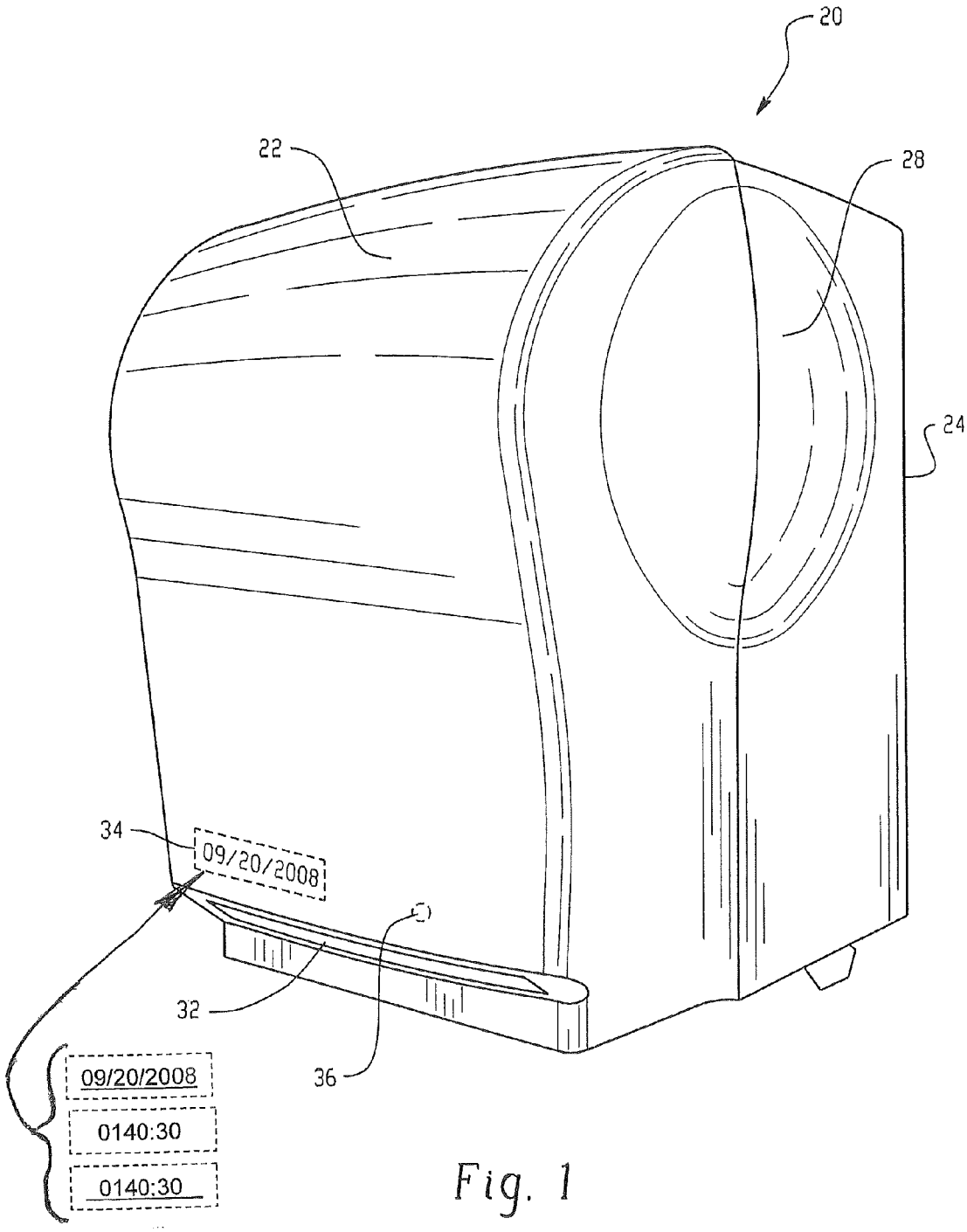
FIG. 1 is a perspective view illustration of a sheet product dispenser in accordance with an exemplary embodiment of the invention.
Figure 2:
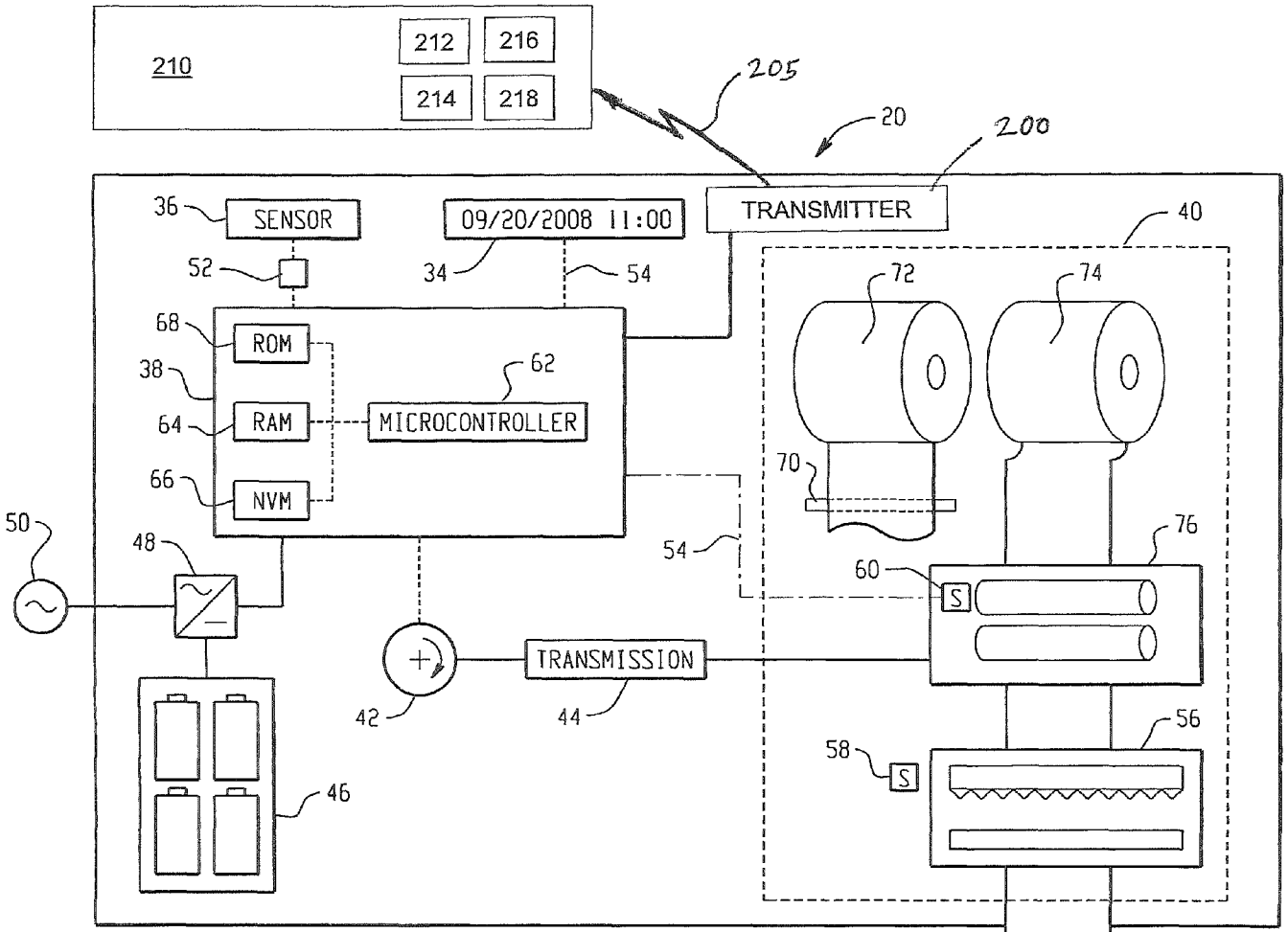
FIG. 2 is a schematic view illustration of the sheet product dispenser of FIG. 1.
Figure 3:
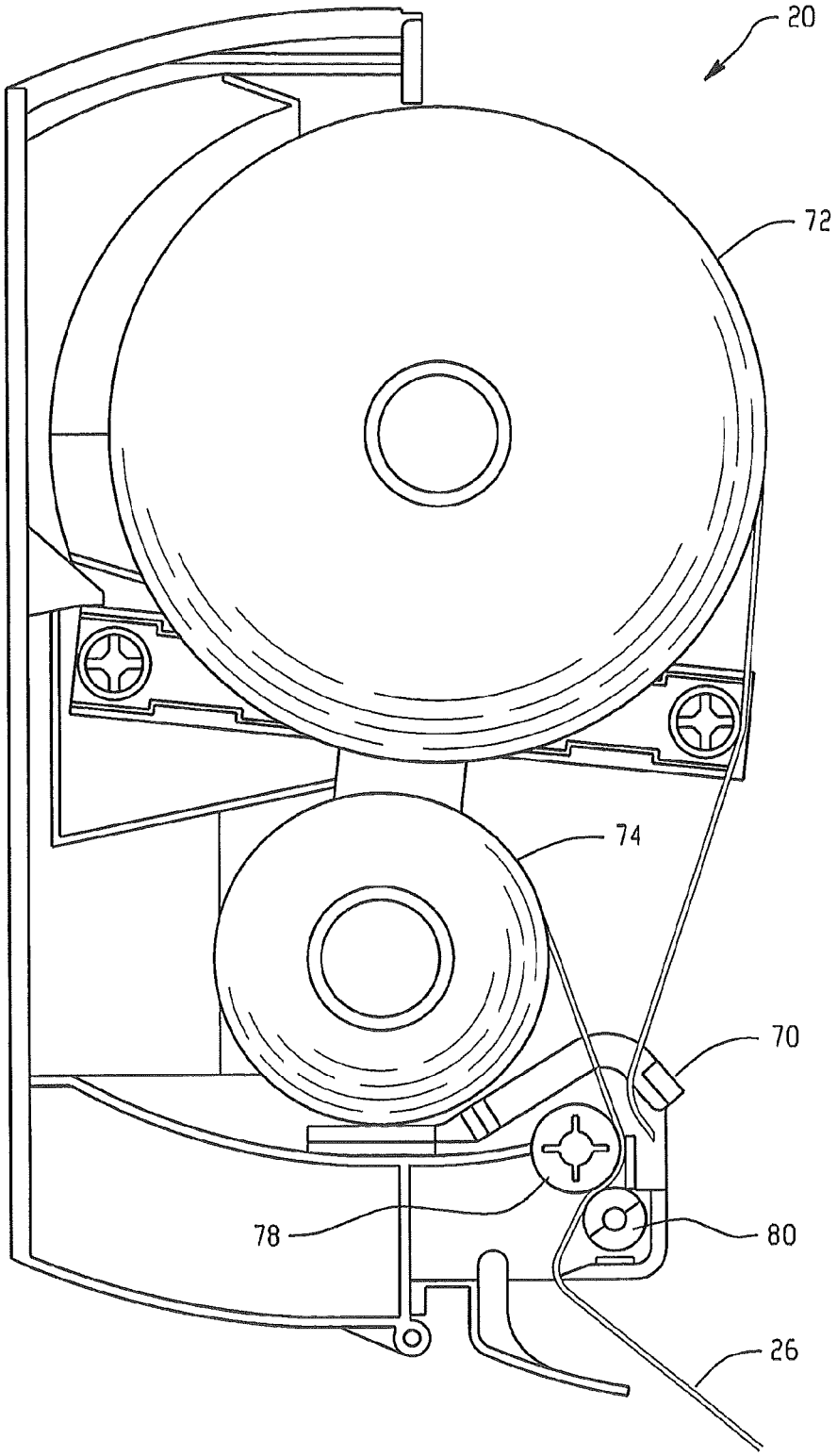
FIG. 3 is a side plan view illustration of the sheet product dispenser of FIG. 1 with the front cover removed.

FIGS. 1-3 illustrate an exemplary embodiment of a sheet product dispenser 20. The sheet product dispenser 20 includes a front cover 22 and a back plate 24 that are arranged to hold and dispense a sheet product 26. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), double re-creped (DRC), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

The sheet product dispenser 20 may include an enlarged portion 28 that provides room in the interior of the sheet dispenser 20 for a full roll of sheet product. The front cover 22 may be formed from any suitable material, such as a plastic, that is cost effective and meets the environmental requirements of the application. In one embodiment, the sheet dispenser 20 is water proof or water resistant, which allows the sheet dispenser to be used in wet environments, such as a food processing facility for example.

The sheet dispenser 20 is arranged with a dispensing slot 32 that provides sheet product to the user. The sheet dispenser 20 may include a display 34 to provide a visual indication as to the status of the sheet dispenser. As will be described in more detail herein, the display 34 may be any type of display capable of providing textual or alphanumeric information, such as a date and time for example. Accordingly, the display may be a light-emitting diode (LED) display, an organic light emitting diodes (OLEDs) display, a liquid-crystal (LCD) display, a cathode-ray tube display, a plasma display or a digital light processing (DLP) display for example. A proximity sensor 36 is also positioned adjacent the front cover 22 near the slot 32. The proximity sensor 36 may be any suitable sensor, such as an infrared sensor for example, that is capable of sensing the presence of a user's hand in front of the sheet dispenser 20.

A schematic representation of the major components of the sheet dispenser 20 is shown in FIG. 2. It should be appreciated that the illustration in FIG. 2 is for purposes of description and that the relative size and placement of the respective components may differ. The sheet product dispenser 20 includes a main controller 38. As will be described in more detail herein, the main controller 38 provides logic and control functionality used during operation of the sheet dispenser 20. Alternatively, the functionality of the main controller 38 may be distributed to several controllers that each provide more limited functionality to discrete portions of the operation of sheet dispenser 20. The main controller 38 is coupled to a dispensing mechanism 40 to dispense a sheet product 26 when a user activates the sensor 36. A motor 42 and an optional transmission assembly 44 drive the dispensing mechanism 40. The optional transmission 44, such as a gearbox for example, adapts the rotational output of the motor 42 for the dispensing of the sheet product 26.

In the exemplary embodiment, the electrical energy for operating the sheet dispenser 20 is provided by a battery 46, which may be comprised of one or more batteries arranged in series or in parallel to provide the desired energy. In the exemplary embodiment, the battery 46 includes four 1.5-volt "D" cell batteries. The battery 46 is connected to the main controller 38 via an optional power converter 48 that adapts the electrical output of the battery 46 to that desired for operating the sheet dispenser 20. The optional power converter 48 may also accept an input from an external power source, such as an alternating current ("AC") power source 50. The AC power source 50 may be any conventional power source, such as a 120V, 60 Hz wall outlet for example.

The main controller 38 is a suitable electronic device capable of accepting data and instructions, executing the instructions to process the data, and presenting the results. Main controller 38 may accept instructions through a user interface, or through other means such as but not limited to a proximity sensor, voice activation means, manually-operable selection and control means, radiated wavelength and electronic or electrical transfer. Therefore, main controller 38 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network or a hybrid of any of the foregoing.

Main controller 38 is capable of converting the analog voltage or current level provided by sensors, such as proximity sensor 36 for example, into a digital signal indicative of a user placing their hand in front of the sheet dispenser 20. Alternatively, sensor 36 may be configured to provide a digital signal to main controller 38, or an analog-to-digital (A/D) converter 52 maybe coupled between sensor 36 and main controller 38 to convert the analog signal provided by proximity sensor 36 into a digital signal for processing by main controller 38. Main controller 38 uses the digital signals as input to various processes for controlling the sheet dispenser 20. The digital signals represent one or more sheet dispenser 20 data including but not limited to proximity sensor 36 activation, stub roll empty sensor 60, tear bar activation sensor 58, motor current, motor back electromotive force, battery level and the like.

Main controller 38 is operably coupled with one or more components of sheet dispenser 20 by data transmission media 54. Data transmission media 54 includes, but is not limited to, solid-core wiring, twisted pair wiring, coaxial cable, and fiber optic cable. Data transmission media 54 also includes, but is not limited to, wireless, radio and infrared signal transmission systems. Main controller 38 is configured to provide operating signals to these components and to receive data from these components via data transmission media 54. Main controller 38 communicates over the data transmission media 54 using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The main controller 38 may also accept data from sensors, such as proximity sensor 36 for example, and devices such as motor 42 for example. Main controller 38 is also given certain instructions from an executable instruction set for the purpose of comparing the data from proximity sensor 36 to predetermined operational parameters.

Main controller 38 includes a processor 62 coupled to a random access memory (RAM) device 64, a non-volatile memory (NVM) device 66, and a read-only memory (ROM) device 68. Main controller 38 may also be connected to one or more input/output (I/O) controllers, data interface devices or other circuitry (not shown) as needed to perform logic functions described herein. NVM device 66 is any form of non-volatile memory such as an EPROM (Erasable Programmable Read Only Memory) chip, a flash memory chip, magnetic media, optical media, a disk drive, or the like. Stored in NVM device 66 are various operational parameters for the application code. As will be described in more detail below, NVM device 66 may further include database application code and data files that may be used to store data received or processed by processor 62. It should further be recognized that application code could be stored in NVM device 66 rather than ROM device 68.

Figure 7:
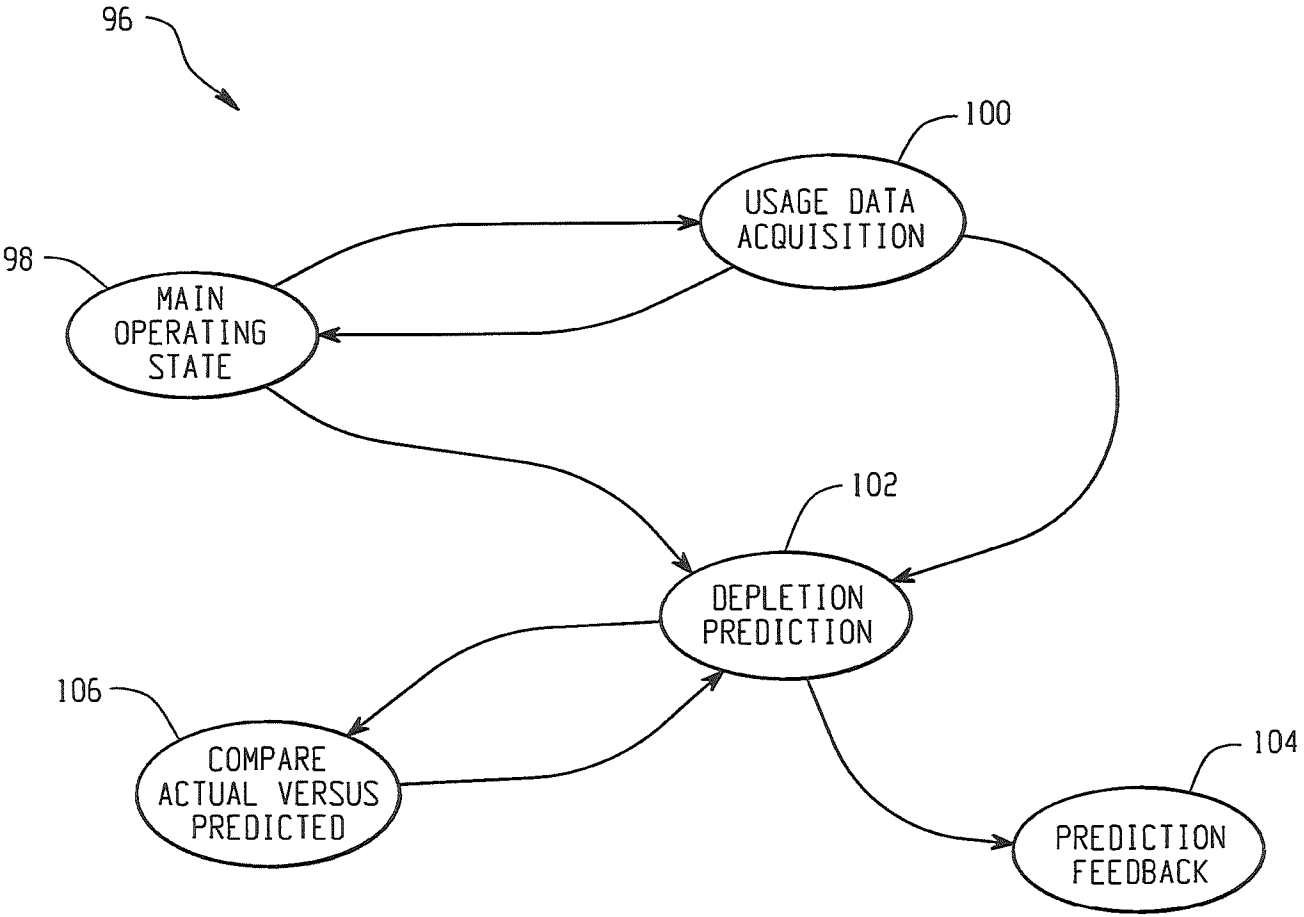
FIG. 7 is an exemplary state diagram illustrating modes of operation of the sheet product dispenser of FIG. 1.
Figure 8:
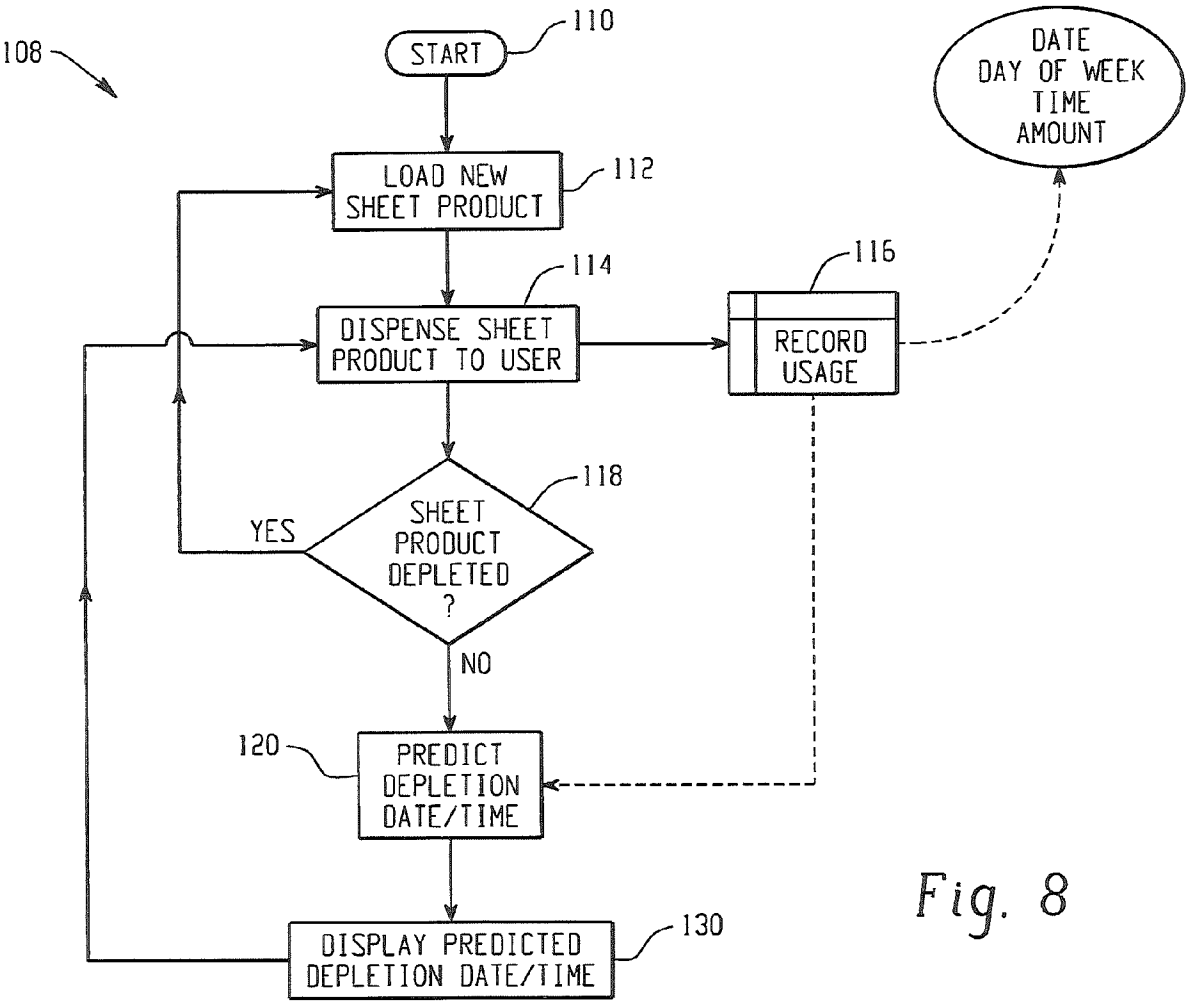
FIG. 8 is an exemplary flow chart diagram for the operation of the sheet product dispenser of FIG. 1; and, FIG. 9 is an exemplary block diagram of the depletion prediction calculation of FIG. 7 or FIG. 8.
Figure 9:
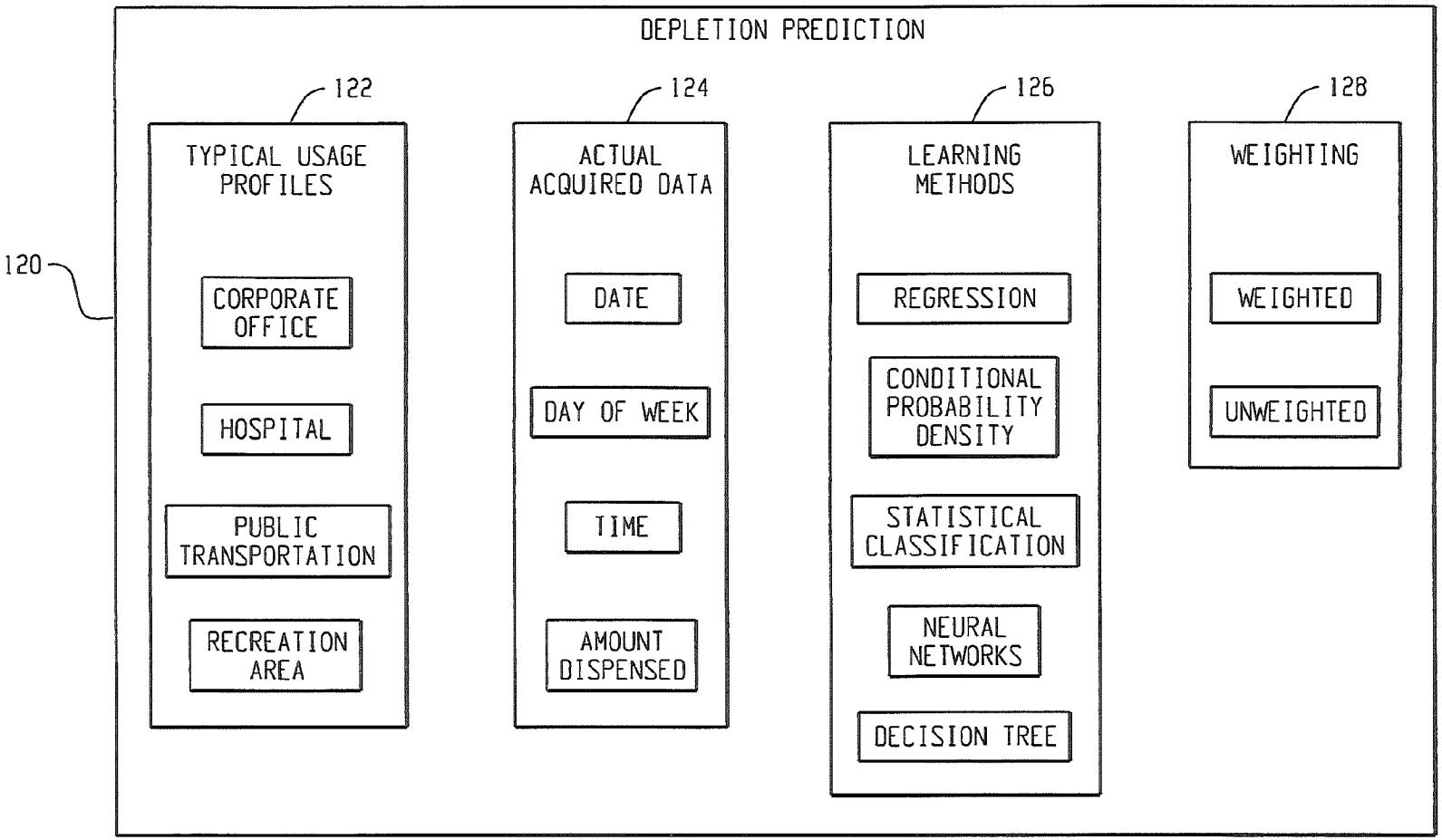

Main controller 38 includes operation control methods embodied in application code, such as those illustrated in FIGS. 7-9. These methods are embodied in computer instructions written to be executed by processor 62, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), PHP (Hypertext Preprocessor), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

The dispensing mechanism 40 may further include a transfer bar 70 that acts to move the end portion of sheet product on main roll 72 from a first position to a second position when a stub roll 74 has been depleted. The sheet product from the main roll 72 then engages the rollers in roller assembly 76 and may thereafter be dispensed.

After the roller assembly 76 pulls the sheet product from either the stub roll 74 or the main roll 72, the sheet product proceeds to tear bar assembly 56. The tear bar assembly 56 is positioned adjacent the dispensing slot 32. A means for cutting the sheet product 26 is included in tear bar assembly 56 once the appropriate amount of sheet product 26 has been dispensed. As will be discussed in more detail below, the tear bar assembly 56 may separate the dispensed sheet product using a sharp edge that cuts into the sheet when the user pulls the dispensed sheet product 26. The separation of the sheet product 26 from the sheet product roll 72, 74 may then be used and discarded as necessary by the user.

A sensor 58 is positioned adjacent to the tear bar assembly 56. The sensor 58 may be provided to generate a signal to the main controller 38 that indicates whether the dispensed portion of sheet product has been separated from the dispenser 20. It should be appreciated that the detection of the sheet product being separated by the tear bar assembly 56 provides a positive feedback to the main controller 38 to de-energize the motor 42.

An exemplary embodiment sheet dispenser 20 is shown in FIG. 3. In this embodiment, the stub roll 74 and main roll 72 are arranged with the main roll being in the upper portion and the stub roll 74 in the lower portion of sheet dispenser 20. The roller assembly 76 includes a feed roller 78 and a pinch roller 80. The location where the rollers meet is commonly referred to as the "nip." The feed roller 78 is coupled for rotation to the motor 42. When maintenance or refill operations are performed on the sheet dispenser 20, the stub roll 74 is positioned in the lower portion and the leading edge portion of the sheet product 26 from stub roll 74 is inserted between the feed roller 78 and the pinch roller 80 at the nip. Friction between the rollers 78 and 80 and the sheet product causes sheet product to be pulled from the stub roll 74 when the motor 42 is activated. Maintenance personnel may also position the main roll 72 in the sheet dispenser 20. The main roll includes a leading edge portion that is positioned adjacent the transfer bar 70.

It should be appreciated that while the exemplary embodiment has been described in reference to a sheet product dispenser having pair of sheet product supplies that are in a roll form. However, the claimed invention should not be so limited. The sheet product dispenser may also be arranged with sheet product packaged in a different form other than a roll form, such as a fan-fold, or a center-pull roll for example. Further, the sheet product dispenser may only have one supply of sheet product for example.

Sheet product dispensers may be used in many different applications. These applications include, but are not limited to restaurants, food-processing facilities, manufacturing facilities, corporate offices, and hospitals for example. The sheet product dispensers may also be used public restrooms, such as in public transportation facilities (e.g. airports, bus stations, train stations) or recreation areas for example. Each of these different application environments may have a different usage profile. The usage profile for a particular sheet product dispenser will determine the frequency in which the supply of sheet product will need to be refilled. For example, a sheet product dispenser located in an airport would likely need to be refilled more frequently than a corporate office.

Figure 4:
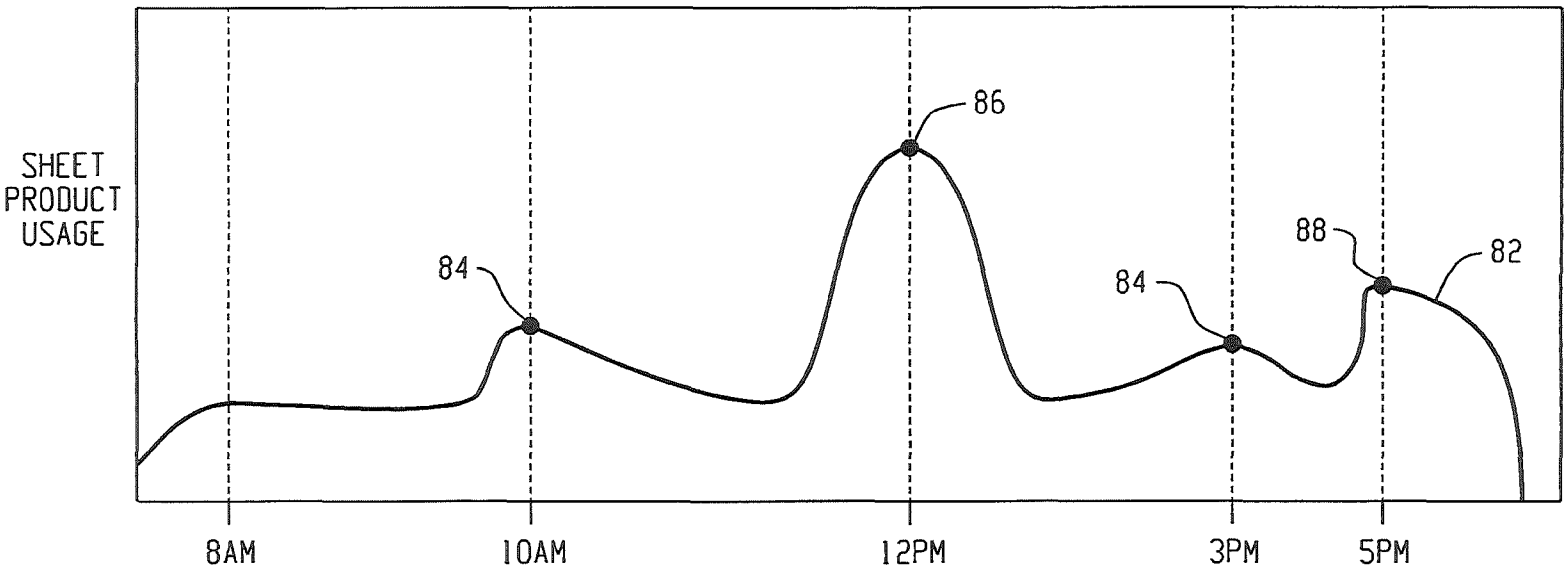
FIG. 4 is an exemplary daily usage profile for a hypothetical sheet product dispenser.
Figure 5:
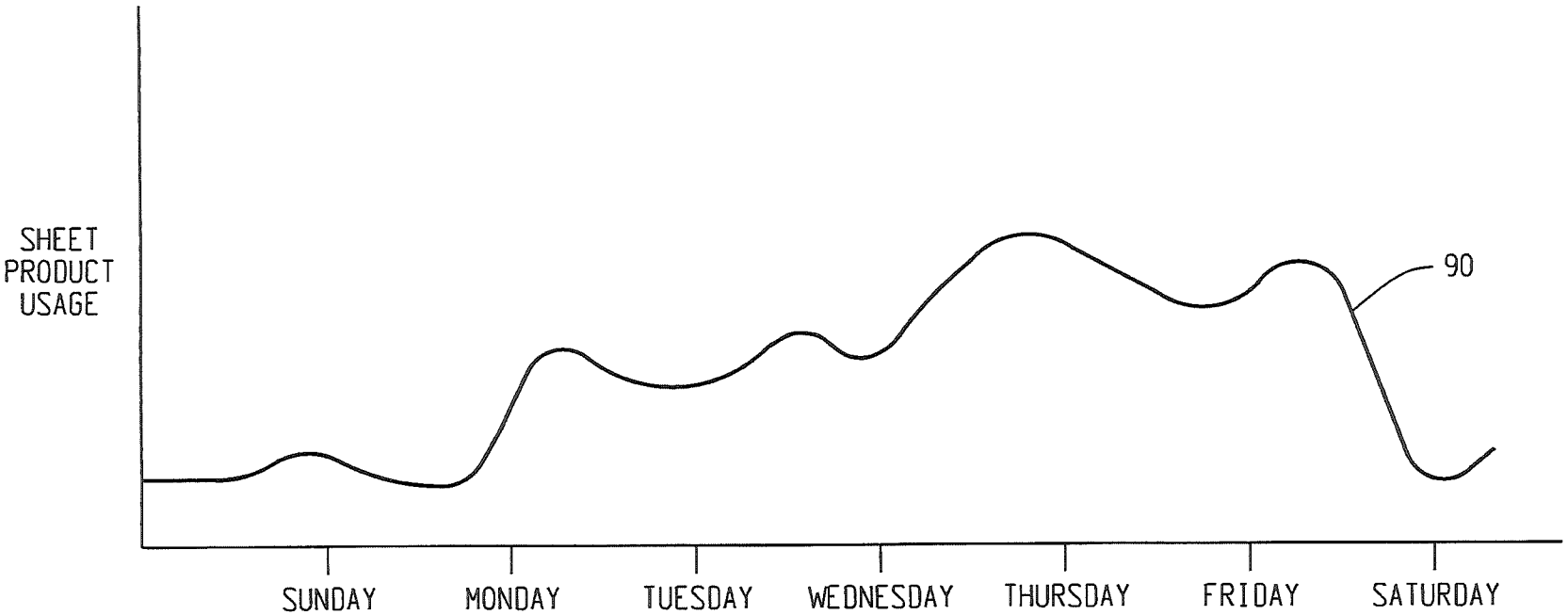
FIG. 5 is an exemplary weekly usage profile for a hypothetical sheet product dispenser.
Figure 6:
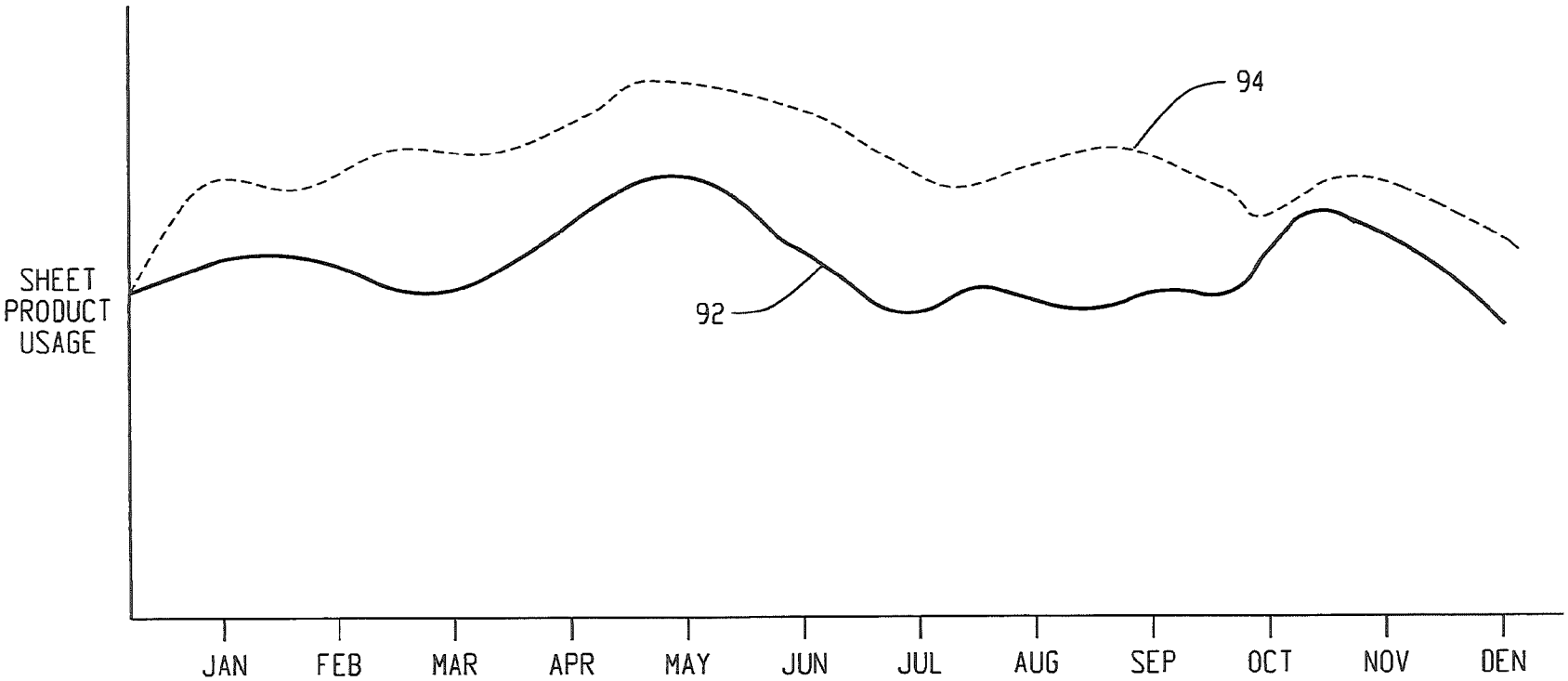
FIG. 6 is an exemplary yearly usage profile for a hypothetical sheet product dispenser.

Hypothetical usage profiles are illustrated in FIGS. 4-6. On a daily basis, the usage profile 82 will vary through out the day as illustrated in FIG. 4. While there will likely be some base level of usage, there will also be peak periods, such as during typical break time 84, lunch time 86 or at the end of the normal work day 88. It should be appreciated that the daily usage profile 82 may be different not only between different applications, but also at different locations within the same application. For example, a sheet product dispenser installed in one airport will have different usage patterns than an identical sheet product dispenser installed at a different airport, as the usage will likely be dependent on the arrival and departure time of aircraft.

When viewed on a weekly basis, the usage profile 90 may also vary from day to day. Certain days of the week, such as weekend days for example, may have a lower usage than during the business week. Similarly, when viewed on an annual basis as illustrated in FIG. 6, there may be seasonal variations in the usage profile 92. Using the airport example discussed above, a sheet product dispenser in an airport may see peak usage during holiday travel times for example.

It should be appreciated that it is undesirable to allow the supply of sheet product (e.g. main roll 72 and stub roll 74) to become depleted. The variations in the usage profiles make the scheduling of maintenance and the refilling of the sheet product supply difficult. This difficulty is further increased when usage profiles change over time, such as when increases in traffic at an airport creates a new usage profile 94 for subsequent years.

Referring now to FIG. 7, a method of operation 96 of sheet product dispenser 20 that provides the operator with a predicted depletion time period for the sheet product supply will be described. The method 96 may be considered as having multiple operating states. These operating states may perform logic functions either in parallel or sequentially and may be embodied as separate or integrated application code that is executed on the processor 62. The method 96 has a main operating state 98 that performs the operational functions typically required for use of the sheet product dispenser 20. The main operating state 98 performs functions such as monitoring the activation of sensor 36 and the dispensing of sheet product by the dispensing mechanism 40. A data acquisition state 100 receives usage data from the operating state 98 with information related to the dispensing of sheet product. As will be discussed in more detail below, this usage data may include information on the date of dispensing, the day of the week, the time of dispensing, and the amount of sheet product dispensed for example. In the exemplary embodiment, the data acquisition state cooperates with non-volatile memory 66 to store the usage data in a machine-readable format in a suitable form, such as a database for example, which allows the usage data to be retrieved in a form usable by method 96.

Method 96 also includes a depletion prediction state 102. The depletion prediction state 102 receives the usage data from data acquisition state 100 and uses the information to provide a prediction to the operator of when the supply of sheet product will be depleted. The depletion prediction state 102 may use techniques, such as machine learning or artificial intelligence for example, that allows the depletion prediction state 102 to make estimates that are based on past usage and trends in the usage data. These techniques include, but are not limited to, regression analysis, conditional probability density analysis, statistical classification analysis, neural networks, decision tree analysis, fuzzy logic, and the like for example. The depletion prediction state 102 may also include preprogrammed usage profiles, such as profiles 90, 92, 94 for example. The depletion prediction state 102 may also develop mathematical prediction models that allow the prediction of the depletion date. The models may includes factors relating to trends and general patterns, such as increased usage over the previous year for example, that increases the accuracy the depletion prediction. These models may be based on the preprogrammed usage profiles that are then modified based on the acquired data, or may be based on the acquired data alone.

The depletion prediction state 102 passes prediction data on the predicted depletion of the supply of sheet product to feedback state 104. This prediction data may include the date of depletion, and the time of depletion for example. The feedback state 104 provides the prediction data in a form usable by the operator. In the exemplary embodiment, the feedback state 104 transmits the prediction data to a display 34 on the dispenser front cover 22. In another embodiment, the prediction data is transmitted to another application software (not shown) such as a facility management system. The facility management system may use the prediction data to allow the operator to dispatch maintenance personnel for example.

The method 96 also may include an optional comparison state 106. The comparison state 106 analyzes the predicted depletion date with actual performance. This allows the comparison state 106 to provide corrections that improve the model used by prediction state 102. This allows an increase in the accuracy of the prediction data for example. The comparison state 106 may change the model used by prediction state 102, or may provide a weighting factor that changes the prediction data. If the prediction data is trending on over estimating the length of time until the sheet product is depleted, the weighting factor may reduce the predicted depletion time period for example.

The operation of the sheet product dispenser 20 may also be considered as a sequence of steps such as the method 108 illustrated in FIG. 8. The method 108 starts in block 110 and proceeds to block 112 where a new supply of sheet product is loaded into the sheet product dispenser 20. When a user desires sheet product, the user activates the dispenser 20, such as by proximity sensor 36 for example. This causes the method 108 to proceed to block 114 where sheet product is dispensed by the dispensing mechanism 44. Data containing information on the usage and dispensing of the sheet product is passed to block 116 that records the data in a machine-readable format, such as in a database that is created in a machine-readable format in non-volatile memory 66 for example. The recordation of data may be triggered by several different indicators that sheet product has been dispensed. These triggers include, activation of proximity sensor 36, tear bar sensor 58, or current draw by the motor 42 for example.

The method 108 then proceeds to query block 118 where it is determined whether the sheet product supply has been depleted. A sensor 60 that monitors the level of sheet product supply may determine if the supply is depleted, or alternatively a sensor positioned near the nip as is known in the art. If the query block 118 returns a positive, the method 108 loops back to block 112 where the sheet product supply is refilled. If the query block 118 returns a negative response, the method 108 proceeds to block 120 where a prediction of when the supply of sheet product will be depleted is determined. The prediction block 120 receives usage data from record block 116

The prediction of when the supply of sheet product will be depleted may be based on many factors as is illustrated in FIG. 9. The depletion prediction may be based on typical usage profiles 122, actual acquired data 124, the machine learning method implemented 126 or any weighting factors 128. As discussed above, the method 108 may have expected usage profiles, such as for a corporate office, a hospital, public transportation facility or recreation areas for example. Alternatively, the profile may be based on the number of people in the facility. These expected usage profiles may allow the prediction block 120 to make predictions on usage before the dispenser 20 has acquired enough data to make reasonably accurate predictions on when the supply of sheet product will be depleted. The prediction block 120 may also use actual data 124, such as the date of dispensing, the day of the week the sheet product was dispensed, the time of dispensing and the amount of sheet product dispensed for example, to either create a prediction model, or alternatively improve upon the expected usage profiles 122.

The prediction block 120 may use any prediction techniques capable of being executed on processor 62 to provide a prediction based on the expected usage profile 122 and/or the actual acquired data 124. These techniques include, but are not limited to, regression analysis, conditional probability density analysis, statistical classification analysis, neural networks, decision tree analysis, fuzzy logic an the like for example. The prediction block 120 may also incorporate weighting factors 128. The weighting factors may be to account for discrepancies between the actual and the predicted usage, or may be set by the operator. The weighting factor may allow the operator to balance the risk of sheet product not being available to a user against the cost of maintenance. For example, the operator of a prestigious restaurant may find it undesirable for its customers not have sheet product available when it is needed. In this case, the restaurant may weight the prediction in favor of more frequent refilling of the dispensers at the expense of increased costs.

After the depletion prediction is made, the method 108 proceeds to block 130 where feedback on the depletion prediction is provided to the operator. In the exemplary embodiment, the feedback is in the form of a display on the front of the dispenser 20. The display allows the operator to see when the dispenser 20 will need to be refilled, such as when the operator does a periodic inspection of the location for example. Once the feedback has been provided, the method 108 loops back to block 114 where sheet product is dispensed when activated by a user.

In view of the foregoing, it will be appreciated that the depletion prediction data that is passed by the depletion prediction state 102 may include not only a predicted date of depletion, a predicted time of depletion, and a predicted time period for depletion of the product 26, but may also include a predicted remaining time to depletion, a predicted time to near-depletion, and a predicted near-depletion date of the product 26. As used herein, "near-depletion" means a not yet fully expired roll of sheet product 26, such as stub roll 74, that is predicted to have less than a predefined amount of product remaining for dispensing (such as 5% remaining for example) by a predicted time/time duration or date, or is predicted to have dispensed a predefined amount of product (such as 95% dispensed for example) by a predicted time/time duration or date. Such other predictions not previously discussed above should be readily appreciated by virtue of the depletion prediction state 102 being capable of utilizing many analytical techniques, such as for example, machine learning or artificial intelligence, that allows the depletion prediction state 102 to make estimates that are based on past usage and trends in the usage data, and techniques that include, but are not limited to, regression analysis, conditional probability density analysis, statistical classification analysis, neural networks, decision tree analysis, fuzzy logic, and the like. As also discussed above, the depletion prediction state 102 may include preprogrammed usage profiles, such as profiles 90, 92, 94 for example. The depletion prediction state 102 may also develop and utilize mathematical prediction models that include factors relating to trends and general patterns, such as increased usage over the previous year for example, that increases the accuracy the depletion prediction. These models, as previously discussed, may be based on the preprogrammed usage profiles that are then modified based on the acquired data, or may be based on the acquired data alone.

With consideration to the foregoing, it will be appreciated that the main controller 38, in combination with the depletion prediction state 102 and preprogrammed information relating to the amount of product 26 initially installed in the dispenser 20, is well equipped to predict a remaining time to depletion, a time to near-depletion, and a near-depletion date of the product 26, which may then be displayed on display 34. As illustrated in FIG. 1, the display 34 may be configured to display one of several types of information, such at: "Sep. 20, 2008" indicating a predicted date of depletion of Sep. 20, 2008; "Sep. 20, 2008" (displayed characters underlined) indicating a predicted near-depletion date of Sep. 20, 2008; "0140:30" indicating a predicted time remaining to depletion of 140-hours and 30-minutes; and, "0140:30" (displayed characters underlined) indicating a predicted time remaining to near-depletion of 140-hours and 30-minutes. While underlining is illustrated herein for indication of "near-depletion" information, it will be appreciated that the scope of the invention is not limited to underlining, but includes any alternative form of illustration suitable for the purposes disclosed herein, such as italics, a different font type, a different font color, a different background color, one or more additional characters added to the display, or a flashing display, to name only a few. As used As previously discussed above, the feedback state 104 transmits the prediction data to a user or a display 34 on the dispenser front cover 22, while in another embodiment, the prediction data is transmitted to another application software such as a facility management system which may use the prediction data to allow the operator to dispatch maintenance personnel for example.

With reference back to FIG. 2, it should be appreciated that an embodiment of the invention also includes a dispenser 20 equipped with a transmitter module 200 that is configured and disposed to be in signal communication with a remotely located user or facility management system 210. The transmitter module 200 is disposed in signal communication with the main controller 38 for receiving and transmitting information from the depletion prediction state 102 to the facility management system 210. The main controller 38, which is operably coupled to the dispensing mechanism 40, includes a processer 62 that is responsive to executable instructions which when executed by the processor 62 facilitates recording of usage data 116 associated with usage of the product 26, calculation of a usage rate 120 of the product 26, and prediction 120 of at least one of: a depletion date of the product; a time to depletion of the product; a time to near-depletion of the product; and, a near-depletion date of the product. The transmitter module 200, which is operably coupled to the main controller 38, is configured to transmit the prediction data to the remote facility management system 210, where the prediction data relates to at least one of the aforementioned: depletion date of the product; time to depletion of the product; time to near-depletion of the product; and, near-depletion date of the product.

In an embodiment, the remote facility management system 210 includes a receiver module 212, a data storage module 214, a data processing module 216, and a data display module 218, where the receiver module 212 is configured to receive a transmission 205 from the transmitter module 200, and where the data storage module 214, the data processing module 216, and the data display module 218, are configured to store, process and display, respectively, the data relating to at least one of the aforementioned: depletion date of the product; time to depletion of the product; time to near-depletion of the product; and, near-depletion date of the product.

It should be appreciated that the transmission 205 from the transmitter module 200 to the receiver module 212 may be accomplished by utilizing any form transmission medium suitable for the purposes disclosed herein, such as by utilizing electrical wiring or cabling, fiber optics, or electromagnetic radiation over a wireless communication network, for example.

It should be appreciated the dispenser 20 and the methods of operation disclosed herein provide a number of advantages to the operator in cost savings and minimization of waste. The dispenser 20 allows the operator to more efficiently dispatch maintenance personnel since periodic manual inspection such as by viewing the supply of sheet product through a transparent front cover 22 will not be required. Further, the dispenser 20 minimizes waste since maintenance personnel may be dispatched to refill the dispenser 20 when it is needed, rather than when the maintenance personnel are visiting the location of the dispenser.

An embodiment of the method of operating the dispenser may be embodied in the form of computer-implemented processes and apparatuses for practicing those processes. The present invention may also be embodied in the form of a computer program product having computer program code containing instructions embodied in tangible media, such as floppy diskettes, CD-ROMs, hard drives, universal serial bus (USB) drives, or any other computer readable storage medium, such as random access memory (RAM), read only memory (ROM), or erasable programmable read only memory (EPROM), for example, wherein, when the computer program code is loaded into and executed by a computer, the computer becomes an apparatus for practicing the invention. The present invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing the invention. When implemented on a general-purpose microprocessor, the computer program code segments configure the microprocessor to create specific logic circuits. A technical effect of the executable instructions is to provide a prediction of when a supply of sheet product will be depleted to enable a more efficient utilization of sheet product and maintenance personnel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc. do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sheet product dispenser, comprising:

a housing configured to receive a supply of sheet product;

a dispensing mechanism disposed and configured to dispense the sheet product from the housing; and a controller operably coupled to the dispensing mechanism, the controller comprising a processer responsive to executable instructions, which when executed by the processor facilitate:

recording of usage data associated with the sheet product;

using the usage data for prediction of at least one of: a depletion date of the sheet product; a time to depletion of the sheet product; a time to near-depletion of the sheet product; and a near-depletion date of the sheet product; and transmission of at least one of: the depletion date of the sheet product; the time to depletion of the sheet product the time to near-depletion of the sheet product and the near-depletion date of the sheet product.

2. The sheet product dispenser of claim 1, further comprising:

a transmitter module operably coupled to the controller, the transmitter module being configured to transmit data to a remote facility management system, the data relating to at least one of: the depletion date of the sheet product; the time to depletion of the sheet product; the time to near-depletion of the sheet product; and the near-depletion date of the sheet product.

3. The sheet product dispenser of claim 1, further comprising:

a display electrically coupled to the controller, the display being configured to display at least one of: the depletion date of the sheet product; the time to depletion of the sheet product; the time to near-depletion of the sheet product; and the near-depletion date of the sheet product, wherein the transmission comprises transmitting to the display at least one of: the depletion date of the sheet product; the time to depletion of the sheet product; the time to near-depletion of the sheet product; and the near-depletion date of the sheet product.

4. The sheet product dispenser of claim 3, wherein:

the processer is further responsive to an executable instruction, which when executed by the processor facilitates displaying at least one of: the depletion date of the sheet product; the time to depletion of the sheet product; the time to near-depletion of the sheet product; and, the near-depletion date of the sheet product, in response to said being determined.

5. The sheet product dispenser of claim 1, wherein:

the processer is further responsive to an executable instruction, which when executed by the processor facilitates calculation of a usage rate of the sheet product.

6. The sheet product dispenser of claim 1, wherein:

the prediction is further based on usage profiles, machine learning, weighting factors, or any combination thereof.

7. The sheet product dispenser of claim 1, wherein:

the prediction comprises one or more techniques selected from the group consisting of: regression analysis, conditional probability density analysis, statistical clarification analysis, neural networks, decision tree analysis, and fuzzy logic.

8. The sheet product dispenser of claim 2, wherein:

transmission of the data from the transmitter module to the remote facility management system is accomplished via electrical wiring or cabling, fiber optics, or electromagnetic radiation over a wireless communication network.

9. A sheet product dispenser system, comprising:

a sheet product dispenser; and a remote facility management system;

wherein the sheet product dispenser comprises:

a housing configured to receive a supply of sheet product;

a dispensing mechanism disposed and configured to dispense the sheet product from the housing; and a controller operably coupled to the dispensing mechanism, the controller comprising a processer responsive to executable instructions, which when executed by the processor facilitate:

recording of usage data associated with usage of the sheet product; and using the usage data for prediction of at least one of: a depletion date of the sheet product; a time to depletion of the sheet product; a time to near-depletion of the sheet product; and a near-depletion date of the sheet product; and a transmitter module operably coupled to the controller, the transmitter module being configured to transmit data to the remote facility management system, the data relating to at least one of: the depletion date of the sheet product; the time to depletion of the sheet product; the time to near-depletion of the sheet product; and the near-depletion date of the sheet product;

wherein the remote facility management system comprises a receiver module, a data storage module, a data processing module, and a data display module;

wherein the receiver module is configured to receive a transmission from the transmitter module;

wherein the data storage module, the data processing module, and the data display module, are configured to store, process, and display, respectively, the data relating to at least one of: the depletion date of the sheet product; the time to depletion of the sheet product; the time to near-depletion of the sheet product; and the near-depletion date of the sheet product.

10. The sheet product dispenser system of claim 9, wherein:

the processer is further responsive to an executable instruction, which when executed by the processor facilitates calculation of a usage rate of the sheet product.

11. The sheet product dispenser system of claim 9, wherein:

the prediction is further based on usage profiles, machine learning, weighting factors, or any combination thereof.

12. The sheet product dispenser system of claim 9, wherein:

the prediction comprises one or more techniques selected from the group consisting of: regression analysis, conditional probability density analysis, statistical clarification analysis, neural networks, decision tree analysis, and fuzzy logic.

13. The sheet product dispenser system of claim 9, wherein:

transmission of the data from the transmitter module to the remote facility management system is accomplished via electrical wiring or cabling, fiber optics, or electromagnetic radiation over a wireless communication network.

14. A sheet product dispenser, comprising:

a sensor;

a housing configured to receive a supply of sheet product;

a dispensing mechanism operably coupled to the supply of sheet product and the sensor, wherein the dispensing mechanism dispenses the sheet product in response to activation of the sensor;

a controller electrically coupled to the sensor and the dispensing mechanism, the controller comprising a processer responsive to executable instructions, which when executed by the processor in response to the sensor being activated, facilitate:

recording of usage data associated with usage of the product;

using the usage data for prediction of at least one of: a depletion date of the product; a time to depletion of the product; a time to near-depletion of the product; and, a near-depletion date of the product; and transmission of at least one of: the depletion date of the sheet product; the time to depletion of the sheet product; the time to near-depletion of the sheet product; and the near-depletion date of the sheet product.

15. The sheet product dispenser of claim 14, further comprising:

a transmitter module operably coupled to the controller, the transmitter module being configured to transmit data to a remote facility management system, the data relating to at least one of: the depletion date of the sheet product; the time to depletion of the sheet product; the time to near-depletion of the sheet product; and the near-depletion date of the sheet product.

16. The sheet product dispenser of claim 15, wherein:

transmission of the data from the transmitter module to the remote facility management system is accomplished via electrical wiring or cabling, fiber optics, or electromagnetic radiation over a wireless communication network.

17. The sheet product dispenser of claim 14, further comprising:

a display electrically coupled to the controller, the display being configured to display at least one of: the depletion date of the sheet product; the time to depletion of the sheet product; the time to near-depletion of the sheet product; and the near-depletion date of the sheet product, wherein the transmission comprises transmitting to the display at least one of: the depletion date of the sheet product; the time to depletion of the sheet product; the time to near-depletion of the sheet product; and the near-depletion date of the sheet product.

18. The sheet product dispenser of claim 17, wherein:

the processer is further responsive to an executable instruction, which when executed by the processor facilitates displaying at least one of: the depletion date of the sheet product; the time to depletion of the sheet product; the time to near-depletion of the sheet product; and, the near-depletion date of the sheet product, in response to said being determined.

19. The sheet product dispenser of claim 14, wherein:

the processer is further responsive to an executable instruction, which when executed by the processor facilitates calculation of a usage rate of the sheet product.

* * * * *